US011344992B2

(12) United States Patent
Bovone

(10) Patent No.: US 11,344,992 B2
(45) Date of Patent: May 31, 2022

(54) ENHANCED ADJUSTMENT DEVICE FOR MACHINING FLAT SHEETS

(71) Applicant: ELETTROMECCANICA BOVONE SRL, Ovada (IT)

(72) Inventor: Vittorio Bovone, Silvano d'Orba (IT)

(73) Assignee: ELETTROMECCANICA BOVONE SRL, Ovada (IT)

( * ) Notice: Subject to any disclaimer, the term of this patent is extended or adjusted under 35 U.S.C. 154(b) by 616 days.

(21) Appl. No.: 16/327,893

(22) PCT Filed: Aug. 1, 2017

(86) PCT No.: PCT/IB2017/054687
§ 371 (c)(1),
(2) Date: Feb. 25, 2019

(87) PCT Pub. No.: WO2018/037303
PCT Pub. Date: Mar. 1, 2018

(65) Prior Publication Data

US 2019/0193239 A1 Jun. 27, 2019

(30) Foreign Application Priority Data

Aug. 24, 2016 (IT) ..... UA2016A006206

(51) Int. Cl.
*B24B 41/04* (2006.01)
*B24B 9/10* (2006.01)
*B24B 47/12* (2006.01)

(52) U.S. Cl.
CPC ..... *B24B 41/04* (2013.01); *B24B 9/10* (2013.01); *B24B 47/12* (2013.01)

(58) Field of Classification Search
CPC ..... B24B 9/10; B24B 9/102; B24B 41/04; B24B 41/047; B24B 41/068; B24B 7/12;
(Continued)

(56) References Cited

U.S. PATENT DOCUMENTS 2,150,749 A * 3/1939 Price ..... B24B 47/20 451/1
2,894,360 A * 7/1959 Alvord ..... B24B 49/18 451/21

(Continued)

FOREIGN PATENT DOCUMENTS

EP 0865870 A2 9/1998
EP 1422024 A1 5/2004

*Primary Examiner* — Tyrone V Hall, Jr.
*Assistant Examiner* — Makena S Markman
(74) *Attorney, Agent, or Firm* — Dickinson Wright PLLC; Andrew D. Dorisio

(57) ABSTRACT

An enhanced adjustment device (10) for machining flat sheets by way of a grinding machine (11), said device being applied to a motorization assembly (12) used to motorize a grinding tool (14) secured to a spindle (16) constrained to a support structure (18) by way of a guide (20) and suitable for implementing an incremental displacement of said grinding tool (14) with respect to an edge of a sheet for compensating for the wear of said tool, comprising mechanical means for automatically/manually enabling/disabling a sliding movement of said spindle (16) with respect to the support structure (18).

8 Claims, 4 Drawing Sheets

Figure 1:
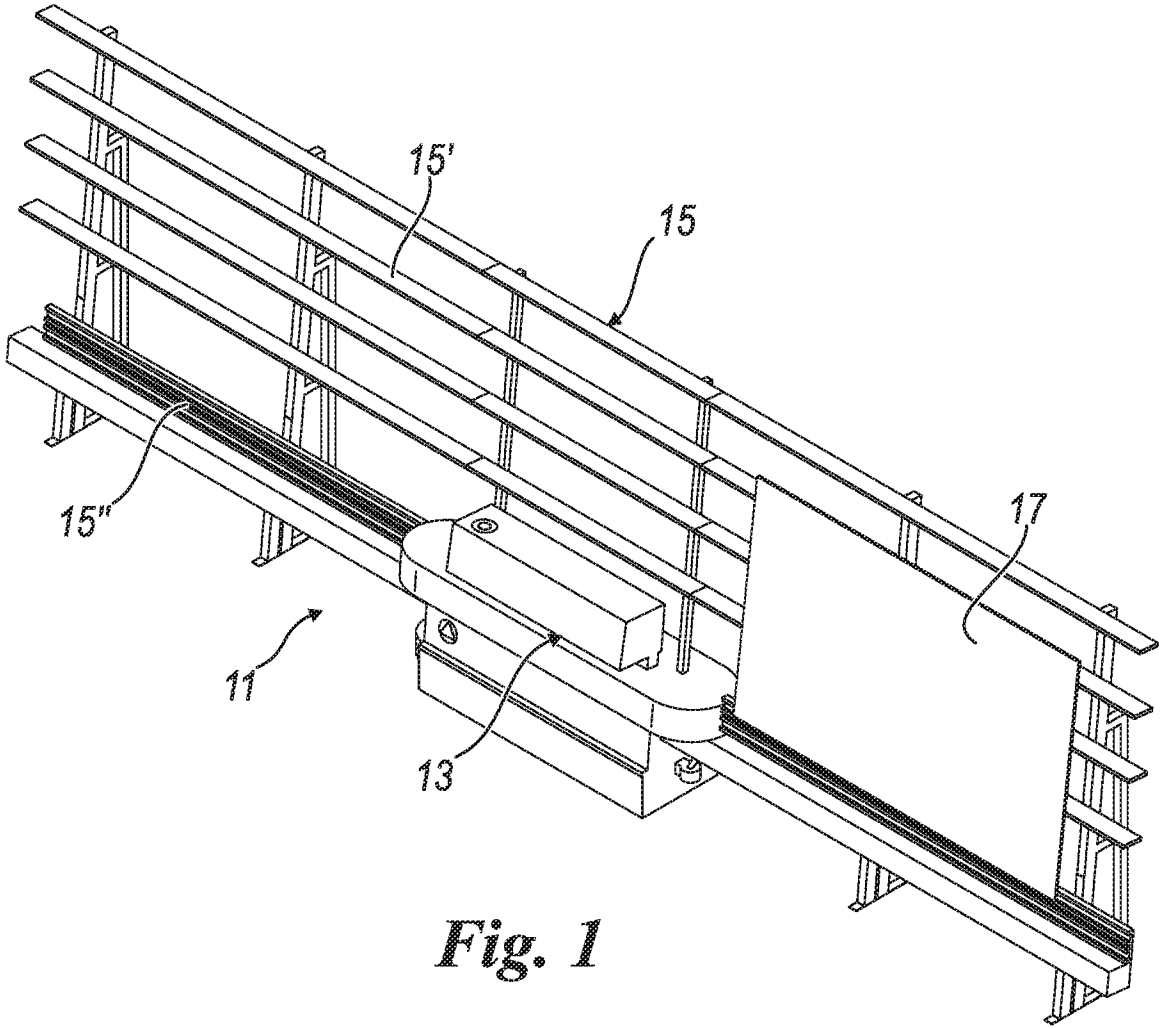

(58) Field of Classification Search
CPC ..... B24B 47/12; B24B 47/203; B24B 47/22; B24B 47/25; B24B 49/02; B24B 49/03; B24B 49/04; B24B 49/186
USPC ..... 451/155, 14, 15, 21, 25, 179
See application file for complete search history.

(56) References Cited

U.S. PATENT DOCUMENTS 3,126,672 A * 3/1964 Calvert ..... B24B 33/02 451/150
3,157,969 A * 11/1964 Fant ..... B24B 49/18 451/21
3,798,845 A * 3/1974 Stevens ..... B24B 49/18 451/21
3,919,810 A * 11/1975 Voumard ..... B23Q 5/402 451/21
4,123,878 A * 11/1978 Lizotte ..... B24B 49/16 451/21
4,266,377 A * 5/1981 Kikuchi ..... B24B 41/062 451/398
8,850,936 B2 * 10/2014 Len ..... B23B 5/28 82/104
2007/0075474 A1 * 4/2007 Vianello ..... B24B 27/0076 269/55

* cited by examiner

ENHANCED ADJUSTMENT DEVICE FOR MACHINING FLAT SHEETS

TECHNICAL FIELD

The present invention refers to an enhanced adjustment device for machining flat sheets.

BACKGROUND

More specifically, the present invention refers to a device used to adjust the grinding wheels used in grinding machines for machining the peripheral edges of flat glass, or plate glass, or mirror glass sheets or even flat sheets made from marble, granite, and similar stone materials.

It is known, with a specific, but not exclusive, reference to glass, that glass is a material widely used in many sectors and for many and different applications.

Among the different types of glass, that referred to as flat glass is used both in the civil field and in the industrial field for realizing walls or for covering facades, for ornaments and floorings, for manufacturing decorative objects, and the like.

Furthermore, a glass sheet is either a single-layer or a multilayer one, i.e. a sheet resulting from the superposition of two or more flat glass sheets, possibly provided with films interposed therebetween and made from technopolymers of the polyvinil butyral or PVB type or equivalent known materials used to obtain glasses featuring blast-proof or bullet-proof properties or the like.

Flat glasses typically undergo a surface machining, called grinding, aiming at eliminating the sharp and irregular edge of the glass sheet.

This removal machining, which is made either manually or automatically, makes it possible to "smooth" and make the edge of the sheet uniform, while also shaping said edge as a function of specific requirements of use and/or aesthetical requirements.

More specifically, it is possible to perform machinings of the following types:

- round polished edge—i.e. a machining whereby the edge thus obtained is round and polished;
- flat polished edge—i.e. a machining whereby the edge thus obtained is polished and perpendicular to the surface of the sheet, the portion joining the edge to the surface of the sheet being chamfered to 45°;
- raw edge—i.e. a machining whereby the edge is opaque and features a degree of roughness greater than that of a polished edge;
- chamfering—i.e. a machining whereby the edges of the glass are ground at an angle whatsoever but lower than 90° as referred to the surface of the sheet, and concerns both the edge and the surface of the sheet and, more specifically, the edge is ground over a length of 10 to 40 mm to form an angle of approximately 7° as referred to the surface of the sheet.

Such machinings, as mentioned here above, are performed manually or by way of appropriate machineries, referred to as grinding machines or chamferers, of a grinding belt type or provided with tools consisting of circular wheels mounted onto a motor or spindle, which drives them into rotation.

With reference to said latter machining tools, they possibly consist of different types of wheels, whose constructional characteristics and component parts can be different as a function of the different types of machining to be carried out on the edges of the flat sheets (for instance, diamond wheels, resinoid-bonded wheels, cerium wheels, polishing wheels, and the like) and/or as a function of the degree of surface finishing pursued for said edge.

If we consider an automatic machining by way of grinding machines, it is conventionally performed by loading the glass sheets, which are arranged vertically, onto the grinding machine, and the sheets are moved along a rectilinear direction, by using a specifically designed transportation device, in the direction of a machining section wherein a set of grinding wheels, variously arranged angularly wise, operate onto the edge of the sheet as a function of selected, specific machining parameters, so as to remove layers of material.

However, while grinding or removing portions/layers of the edge of a sheet, the grinding wheels that are in contact with the mentioned edge tend to consume and consequently they need for a periodical and regular re-positioning, so as to permanently provide an optimum machining of the surface of the edge of the sheet.

Typically is the compensation for the wear of the grinding wheels performed by an operator who manually re-positions the grinding tool in order for it to be permanently in contact with the edge of the sheets to be machined.

Such a manual adjustment entails a number of major drawbacks bound to the fact that the adjustment of the grinding tool for compensating for its wear shall be performed while the machine is not in operation, which possibly entails downtimes which result in extending the machining times and consequently in increasing the associated costs.

A further drawback of the traditional manual adjustment systems consists in that they are not capable of guaranteeing a high repeatability of the adjustment and, also, a manual adjustment might be affected by errors bound to inattentions or errors made by the operators, which do not allow to guarantee an optimum quality of machining.

An object of the present invention is to obviate the above-mentioned drawbacks.

SUMMARY

More specifically, an object of the present invention is to provide an enhanced adjustment device for machining the edges of flat, flat glass sheets and the like, which allows to permanently guarantee an optimum machining of the edge of the glass sheet and a constant quality of machining.

A further object of the present invention is to provide an adjustment device for grinding tools suitable for making it possible a continual adjustment for compensating for the wear of the grinding wheel without being obliged to stop the machine and suffering downtimes.

A further object of the present invention is to put at the user's disposal an automatic grinding tool adjustment device suitable for guaranteeing a high strength and reliability over time and also for being implemented in an easy and cost-effective manner.

These objects and others are achieved by the invention that features the characteristics described in claim 1.

According to the invention, an enhanced adjustment device is provided for machining flat sheets by way of a grinding machine, said device being applied to a motorization assembly used to motorize a grinding tool secured to a spindle constrained to a support structure by way of a guide and suitable for realizing an incremental displacement of said grinding tool with respect to an edge of a sheet, thus compensating for the wear of said tool, comprising automatically/manually operated mechanical means for enabling/disabling a sliding movement of said spindle with respect to the support structure.

Advantageous embodiments of the invention are apparent from the dependent claims.

BRIEF DESCRIPTION OF THE DRAWING FIGURES

Figure 2:
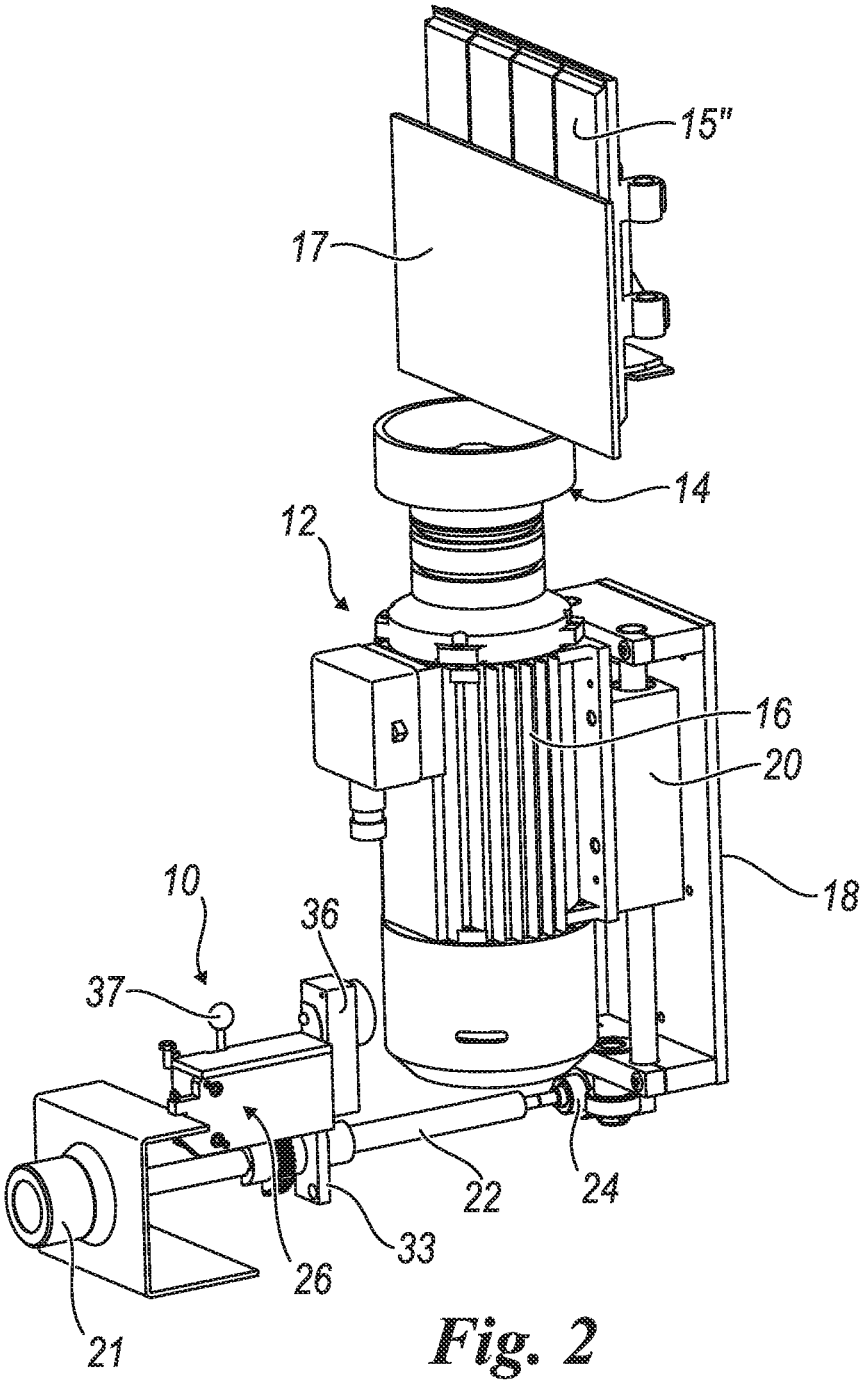
Figure 3:
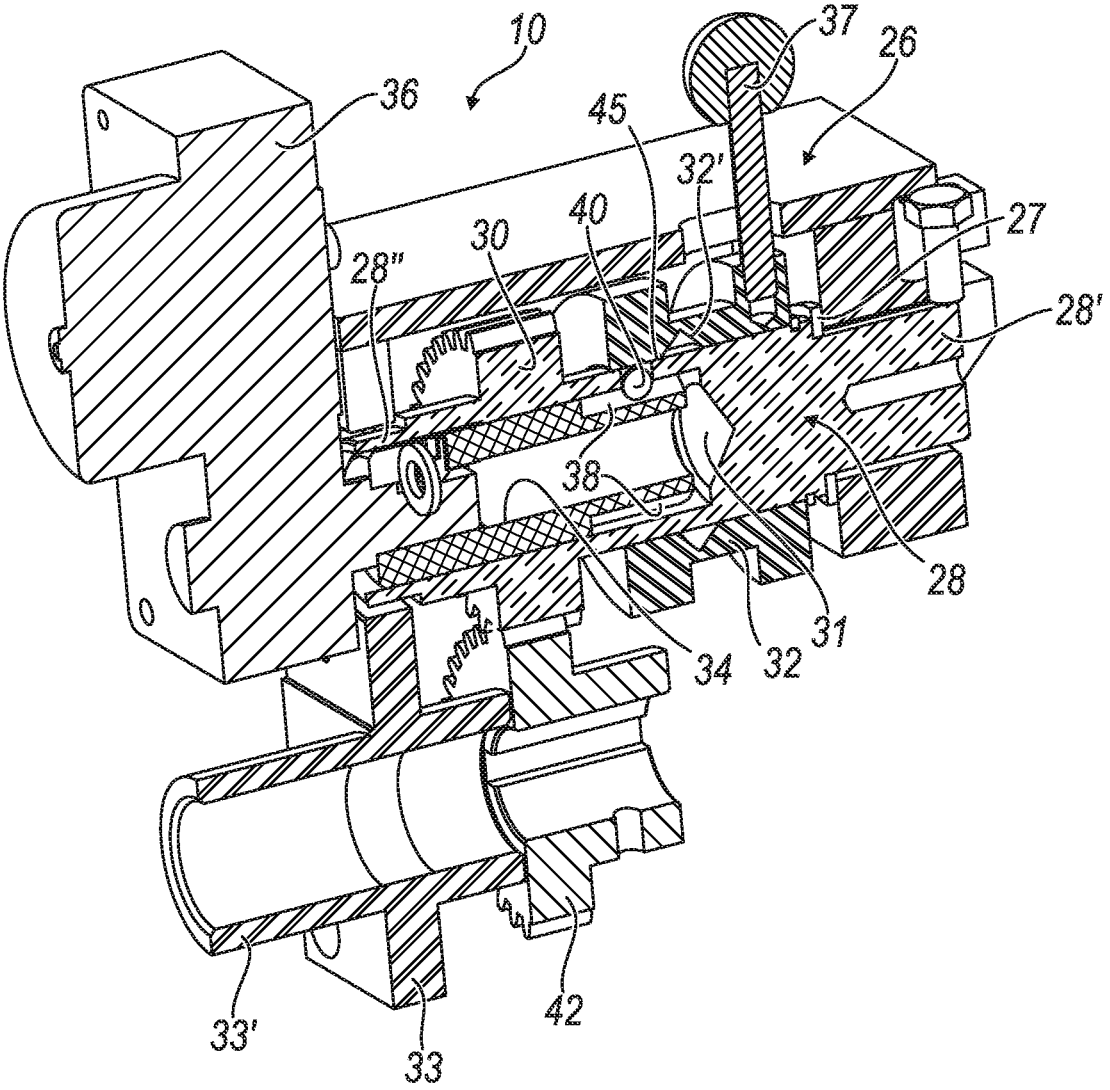
Figure 4:
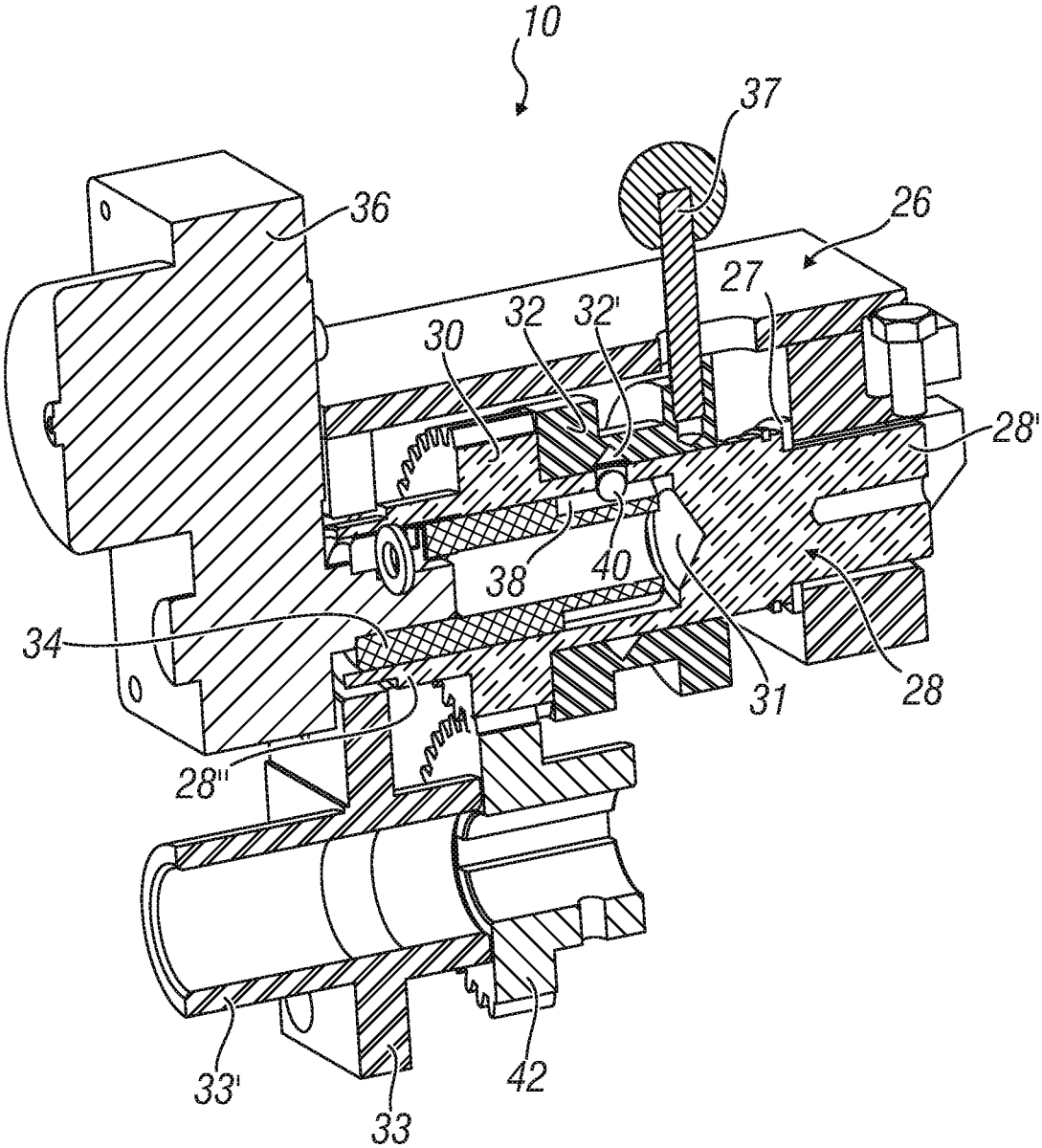

The constructional and functional characteristics of the enhanced adjustment device for machining flat sheets according to the present invention can be better understood from the following detailed description, wherein reference will be made to the attached drawings which illustrate a preferred, not limitative embodiment thereof and wherein:

FIG. 1 schematically shows an axonometric view of a traditional grinding machine onto which a flat sheet is loaded;

FIG. 2 schematically shows an axonometric view of a motorization assembly used to drive a grinding tool equipped with the adjustment device of the present invention;

FIG. 3 schematically shows an axonometric view of the adjustment device according to the invention, cross-sectioned along a longitudinal plane and illustrated in a first operating configuration (specifically, an automatic operation);

FIG. 4 schematically shows an axonometric view of the adjustment device according to the invention, also cross-sectioned along a longitudinal plane and illustrated in a second operating configuration (specifically, a manual operation).

DETAILED DESCRIPTION OF THE INVENTION

With reference to the mentioned figures, the enhanced adjustment device for machining flat sheets according to the present invention and identified by the reference numeral 10 as a whole in the mentioned figures is applied to a motorization assembly 12 to drive a grinding tool 14 of a grinding machine 11.

The grinding machine 11 is not described in details here because it is a machine of a known type, which typically comprises a machining assembly 13 including machining tools 14, a support structure 15 which supports and moves the sheets to be machined, said structure comprising a rack or lateral frame 15' on which the sheet rest and a conveyor 15" used to move the sheet itself, the machining assembly 13 being positioned centrally with respect to the structure 15, so as to define an input zone and an output zone for a sheet 17 with respect to said machining assembly.

The machining assembly 13 comprises a set of tools for grinding the edge of the sheet, which are schematically shown in FIG. 2 which shows one grinding tool 14 only. Said grinding tool 14 is rotatably secured to a spindle 16 supported by a support structure 18 rigidly secured to the machining assembly 13.

More specifically, the spindle 16 is slidingly arranged with respect to the support structure 18 via a guide 20, typically but not exclusively of a recirculating balls type or the like, to be able to adjust the position of the grinding tool as better explained below.

The motorization assembly 12 also comprises an adjustment device 10, which is connected to the guide 20 by way of a transmission shaft 22 and an angular gear box 24 (typically, but not exclusively a conical gear box) connected to one end of the shaft, said shaft comprising, on the side opposed to that which connects to the angular gear box 24, a manually operated adjustment knob 21.

Said adjustment device 10, as schematically shown, for instance, in FIG. 3, comprises a container element or box 26, preferably a longitudinally developing parallelepiped one, internally to which there is arranged a shaft 28 rotationally supported by way of traditional bearings 27 or bushings or equivalents means suitable for this purpose, put on said shaft 28 in correspondence with the opposite end portions 28' and 28".

The shaft 28 comprises a first wheel 30, preferably a toothed one, arranged coaxially to said shaft between the two opposed end portions 28' and 28" and made integral therewith or, according to an alternative embodiment, rigidly secured to the shaft 28 by way of an interference, gluing, or key connection or another known retention means. A sleeve 32 is put on the shaft 28 between the end portion 28' and the first wheel 30, said sleeve 32 being capable of sliding with respect to the shaft 28, as better explained below.

Said sleeve 32 comprises a pocket 32' circumferentially developed in the thickness of the sleeve starting from its inner lateral surface.

In addition, a manually operated lever 37 is secured to said sleeve 32, suitable for making said sleeve 32 axially sliding with respect to the shaft 28 which it is put on, in order to make the adjustment device according to the invention switching from an automatic operation to a manual operation.

In accordance with an alternative embodiment, the manually operated lever 37 is replaced by an actuator which allows for the adjustment device to switch from an automatic adjustment configuration to a manual adjustment configuration according to a permanently controlled, power assisted operation.

In addition, the shaft 28 includes a blind axial cavity 31, developing from the end portion 28" in the direction of the opposed end 28' and suitable for defining a seat for the accommodation of a further shaft 34 internally to said axial cavity.

A motor 36 is arranged outside the container element or box and is connected to the further shaft 34 for the function described below.

The further shaft 34, on the opposed side with respect to that connecting to the motor 36, defines at least one pocket 38 developed in the thickness starting from the outer lateral surface of said further shaft and according to a radial direction, the function of which is to define a seat for accommodating a sphere 40 which partially inserts into at least one through opening 45 formed on the lateral surface of the shaft 28 in correspondence with said pocket to define a coupling between said shaft 22 and said further shaft 34, the sphere 40 being suitable for allowing for the further shaft 34 and the shaft 28 to lock to/unlock from each other in order to make said two components integral with each other and to enable/disable the rotation imparted by the motor 36.

The container element or box 26 includes a plate-like appendage 33 which develops externally to the container element or box according to a direction transversal to the direction of longitudinal development of said container element or box and comprises a tubular element 33' which is internally hollow and is suitable for accommodating and rotatably supporting the transmission shaft 22, said transmission shaft, on which a second, preferably toothed wheel 42 is coupled, coupling with and engaging the first wheel 30 of the shaft 28.

As better explained below, the first wheel 30 defines a driving wheel rotatably driven by the motor 36 whereas the second wheel 42 is a driven wheel and is driven into rotation by the first wheel 30.

The operation of the adjustment device according to the invention, as described in details with reference to its own component parts, is described below.

FIGS. 3 and 4 illustrate the operating configurations of the adjustment device in an automatic mode and in a manual mode, respectively.

Whenever the adjustment device 10 is set to the automatic adjustment configuration (FIG. 3), the bushing 32 is positioned in correspondence with the end portion 28' of the shaft 28, the sphere 40 being completely contained in the seat defined by the pocket 38 of the further shaft 34 and by the through opening 45 of the shaft 28, so as to make said two shafts integral with each other and to implement a rotational coupling between said further shaft 34 and the shaft 28.

In this way, whenever the motor 36 drives the further shaft into rotation, the latter drives the shaft 28 into rotation and, consequently, the first toothed wheel 30, which is a driving wheel, drives into rotation the second toothed wheel 42, which is the driven wheel that drives into rotation the transmission shaft 22 which, via the gear box 24, transmits motion to the guide 20 which, in turn, makes the spindle 16 move with respect to the support structure 18 and consequently makes the grinding tool 40 move forward with respect to the edge of the sheet 17 to be machined.

The motor 36 is typically a fixed-speed one, however, in accordance with an alternative embodiment, motors are used suitable for operating at two driving speeds, namely a low speed when performing a grinding tool adjustment operation with respect to the edge of the sheet, and a high speed when performing a quick positioning of the grinding tool.

In addition, the spindle 16 can be made slide with respect to the support structure 18 and manage the increment of the grinding tool as a function of its consumption/wear by using the motor 36 to control a micro forward movement of the grinding tool 14 as a function of predetermined values for the lengths of the edges of machined flat glass sheets or, alternatively, as a function of the absorption of the spindle that drives the grinding tool into rotation.

In the manual mode, the adjustment configuration is obtained by manually acting onto the lever 37 or by using a remote control, which forcedly makes the sleeve 32 axially move forward in the direction of the first toothed wheel 30, so as to position the pocket 32' of said sleeve in correspondence with the seat of the sphere 40 defined by the pocket 38 of the further shaft 34 and by the through opening 45 of the shaft 28; this makes the sphere 40 engage said pocket 32' of the sleeve 32 and simultaneously disengage from the pocket 38 of the further shaft 34, thus determining a rotational disconnection of said further shaft 34 from the shaft 28 (the sphere 40 is forced to occupy the pocket 32' of the sleeve because of the elastic action exerted by an elastic element of a traditional type (not shown), such as, for instance, a helical spring or another known type of spring suitable for this purpose).

The device being set to such configuration, an operator can act onto the adjustment knob 21 to drive into rotation the transmission shaft 22 which, as described above, activates the guide 20 (via the gear box 24) which allows for the spindle (and consequently the grinding tool 14) to move forward in the direction of the edge of the sheet 17.

Such manual operating mode of the adjustment device might be taken advantage of to adjust the position of the grinding tool while assembling such tools.

The advantages achievable with the adjustment device according to the invention are apparent from the foregoing. The enhanced adjustment device for machining flat sheets according to the present invention advantageously makes it possible to adjust, in a fully automatic way, the position of a grinding tool with respect to the sheet to be machined, so as to compensate for the wear of said tool and to provide constant finishing characteristics of the machined edge and, consequently, a high quality of the product being machined; in this case, the operator performs a monitoring function only.

Further advantageous is the fact that the adjustment device according to the invention makes it possible to adjust the increment of the grinding tool as a function of its degree of wear continually, without any needs for stopping the machine and causing downtimes.

A further advantage of the present invention consists in that the grinding tool increment adjustment device according to the present invention drastically reduces the possibility of any errors by the operators who traditionally perform this adjustment manually; as a matter of fact, the adjustment is performed automatically by the control unit of the grinding machine which operates the adjustment device as a function of predetermined values at the start of the production cycle or, alternatively, as a function of data continually sent by sensors installed in correspondence with the individual grinding tools.

Whereas the invention has been described here above with a particular reference to one embodiment, which has been described for explanatory, non-limitative purposes only, numerous modifications and variants will be apparent to those skilled in the art in the light of the above description. Therefore, the present invention is to be construed to embrace any modifications and variants that fall within the scope of the following claims.

The invention claimed is:

1. An enhanced adjustment device (10) for a spindle (16) of a grinding machine (11) for machining flat sheets applied to a motorization assembly (12), the spindle (16) used to motorize a grinding tool (14) secured to the spindle (16), said spindle (16) being slidably constrained to a support structure (18) of said grinding machine by way of a guide (20) said enhanced adjustment device comprising:

a transmission shaft (22) adapted for indirectly connecting the enhanced adjustment device to the grinding machine;

an angular gear box (24) coupled with said transmission shaft;

a shaft (28);

a sleeve (32) coaxial with the shaft (28) and slidable along an axis of the shaft;

a container element or box (26) and a motor (36) secured to said container element or box (26) and connected to the shaft (28) rotatably arranged internally to said container element or box (26), wherein the motor (36) drives the shaft (28) into rotation by way of a further shaft (34) arranged internally and coaxially to an axial cavity (31) of the shaft (28);

wherein the enhanced adjustment device is adapted for enabling and disabling an automatic and a manual incremental displacement of said grinding tool (14) with respect to an edge of a flat sheet (17) for compensating for the wear of said tool;

wherein the sleeve (32) is adapted to be automatically or manually operated, with respect to a shaft (28);

wherein the shaft (28) is coupled with the transmission shaft (22) of the guide (20) by means of a first wheel (30) which couples with a second wheel (42) of the transmission shaft (22); and wherein the shaft (28) comprises at least one through opening (45) formed on a lateral surface of the shaft, and wherein the further shaft (34) comprises at least one pocket (38) formed on an outer lateral surface of the further shaft in correspondence with the through opening (45) and developing in the thickness of said further shaft according to a radial direction, said through opening (45) and pocket (38) defining a seat for accommodating a sphere (40) suitable for making said shaft (28) rotationally integral with said further shaft (34).

2. The adjustment device according to claim 1, characterized in that the sleeve (32) comprises a pocket (32') circumferentially developing along its inner lateral surface.

3. The adjustment device according to claim 1, further comprising means for manually operating an axial displacement of the sleeve (32) with respect to the shaft (28).

4. The adjustment device according to claim 1, further comprising means for automatically activating an axial displacement of the sleeve (32), wherein said means comprises an actuator connected to the sleeve (32).

5. The adjustment device according to claim 1, characterized in that, in an automatic adjustment configuration, the sphere (40) is positioned in the seat defined by the pocket (38) of the further shaft (34) and by the through opening (45) of the shaft (28) to make said shaft (28) and further shaft (34) driven into rotation by the motor (36) integral with each other, and in that, in a manual adjustment configuration, the sleeve (32) is made axially slide with respect to the shaft (28) and is positioned with the pocket (32') in correspondence with the through opening (45) to accommodate the sphere (40) in said pocket (32') and to disconnect said shaft (28) from the further shaft (34).

6. The adjustment device according to claim 3, characterized in that the means for manually operating the axial displacement of the sleeve (32) comprises a lever (37) secured to the sleeve (32).

7. The adjustment device according to claim 5, characterized in that, in the automatic adjustment configuration the first wheel (30) defines a driving wheel rotatably driven by the motor (36) and driving into rotation the second wheel (42) defining a drive wheel.

8. The adjustment device according to claim 5, characterized in that, in the manual adjustment configuration the guide (20) is activated by means of a rotation of the transmission shaft (22) driven into rotation through the adjustment knob (21).

* * * * *